US006430837B1

(12) United States Patent
Strothmann

(10) Patent No.: US 6,430,837 B1
(45) Date of Patent: Aug. 13, 2002

(54) STOP MEMBER HAVING PANEL THICKNESS MEASURING DEVICE FOR USE WITH POSITIONING CONVEYOR WHICH HORIZONTALLY ALIGNS PANELS

(75) Inventor: Wilfried Strothmann, Schloss Holte-Stukenbrock (DE)

(73) Assignee: Wilfried Strothmann GmbH & Co. KG Maschinenbau und Handhabungstechnik, Schloss-Holte-Stukenbrock (DE)

( * ) Notice: Subject to any disclaimer, the term of this patent is extended or adjusted under 35 U.S.C. 154(b) by 70 days.

(21) Appl. No.: 09/648,888

(22) Filed: Aug. 25, 2000

(30) Foreign Application Priority Data

Aug. 28, 1999 (DE) ..... 199 41 037

(51) Int. Cl.[7] ..... G01B 7/06
(52) U.S. Cl. ..... 33/833
(58) Field of Search ..... 33/833, 1 BB, 33/712, 832, 834, 501.04, 679.1

(56) References Cited

U.S. PATENT DOCUMENTS 2,720,707 A * 10/1955 Bickley ..... 33/833
3,298,605 A * 1/1967 Bucke et al. ..... 235/98 R
4,941,269 A * 7/1990 Mori et al. ..... 33/501.04
5,129,152 A * 7/1992 Barr ..... 33/503
5,806,398 A * 9/1998 Emerson et al. ..... 271/265.04

FOREIGN PATENT DOCUMENTS

DE 0125332 11/1984

* cited by examiner

*Primary Examiner*—Christopher W. Fulton
(74) *Attorney, Agent, or Firm*—Richard M. Goldberg

(57) ABSTRACT

A positioning conveyor for horizontally aligning panels, metal sheets and the like, with a conveying table, which is provided with driving arrangement, and at least one stop (10, 14) at an edge of the conveying table, has a thickness measuring device (22, 24, 54), which is provided at the stop for measuring the panel thickness of the contacting panels, metal sheets, or like.

9 Claims, 2 Drawing Sheets

STOP MEMBER HAVING PANEL THICKNESS MEASURING DEVICE FOR USE WITH POSITIONING CONVEYOR WHICH HORIZONTALLY ALIGNS PANELS

BACKGROUND OF THE INVENTION

The invention relates to a stop member having a panel thinness measuring device for use with a positioning conveyor for horizontally aligning panels, sheet metal and the like with a conveying table, provided with a driving means, and the stop member being at an edge of the conveying table.

With machining panel materials of all types, especially sheet metal or blanks, billets or bars, in one machining station, especially with metal-forming machine tools, it is necessary to position the individual pieces precisely in the horizontal direction before the machining. In this sense, the object of the invention is referred to as "positioning conveyor" since it has, at least, the function of conveying and positioning the conveyed panels. In practice, usually individual panels are taken from a stack, transferred to the positioning conveyor addressed here, moved on this against a stop and also accurately positioned laterally and then inserted, perhaps with a suction cup lifting conveyor, precisely in position in the machining station. The positioning conveyor therefore represents the last station before the machining device. Here there is also the last opportunity to check whether the singling has actually taken place.

Particularly in case of thin panels, it may happen that two or more panels pass through the singling equipment, if the panels are glued together by rust preventatives, drawing agents, etc. or connected by adhesion. However, if two or even three panels are brought into the downstream machining station, loads arise, for which this station is not equipped so that, as a rule, the tools or even the machining station as a whole, are damaged or even destroyed. Similar problems arise if a panel of greater thickness happens to be among the panels supplied. It is consequently of a great importance that only an intended panel reaches the machining station.

SUMMARY OF THE INVENTION

It is therefore an object of the invention to provide a positioning conveyor of the type named above, by means of which the aligned panels can be checked in relation to the effective singling of the panels.

Pursuant to the invention, this objective is accomplished for a positioning conveyor of the above type by a thickness-measuring device, which is provided at the stop for measuring the panel thickness of the contacting panels, sheet metal or the like.

If the nominal thickness of the panel has been entered into such a measuring device at the start, such a thickness measurement itself, even if the accuracy of the measurement is limited, can determine whether only one panel or two or even more panels have reached the aligned position. If more than one panel is measured, an appropriate signal from the measuring device can then stop the equipment.

Preferably, an anvil surface, which supports the contacting panels, is provided at the stop and at least one tracing finger, which can be lowered, is mounted at the stop in a position above the anvil surface. The contacting panels can therefore be clamped with an appropriate force between the anvil surface and the tracing finger. By these means, measuring errors, which arise because of a curvature of the measured panels, are avoided.

Preferably, the tracing finger is mounted pivotably at the stop. This is a solution, which not only can be realized easily constructively, but also one which offers the advantage that the tracing finger can be swiveled out of the region above the panel and the panel can be lifted off with a lifting conveyor or a robot arm. The swiveling movement can be detected by a distance measuring device, which produces a distance signal, either directly or after conversion into a linear movement. The distance-measuring device preferably is constructed so that it puts out the difference between a measurement signal when the tracing finger is lowered completely onto the anvil surface and when it is lowered onto the surface of a contacting panel, as a signal reflecting the thickness of the panel.

The swiveling of the tracing the finger can be converted, for example, by a rack-and-pinion gear into a linear motion of the armature of a differential transformer.

In the case of a preferred embodiment, two tracing fingers at the stop, mounted pivotably on a common axis, are laterally offset so that panels, which come in at an angle and the leading edge of which is not at like angles and perpendicular to the conveying direction, can also be detected.

BRIEF DESCRIPTION OF THE DRAWINGS

In the following, preferred examples of the invention are explained by means of the attached drawing, in which.

DETAILED DESCRIPTION

Figure 1:
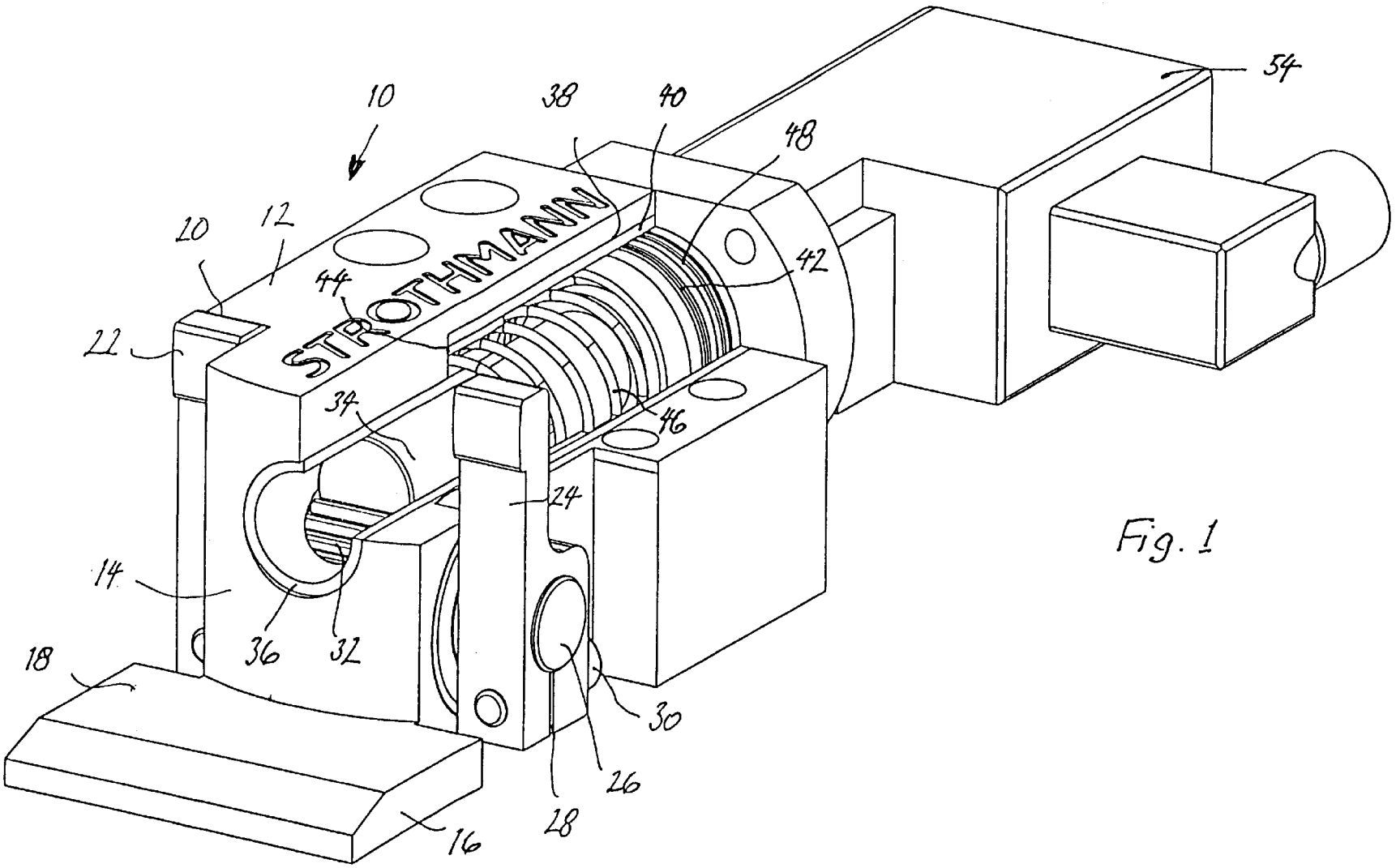
FIG. 1 is a partially broken open, perspective representation of an inventive stop in the readiness position and FIG. 2 corresponds to FIG. 1, but shows the measuring position.

According to FIG. 1, a stop 10 comprises a housing 12, the vertical wall surface of which, facing the viewer, serves as a stop surface 14 for the panels. This stop surface 14 is slightly curved in the horizontal position, so that even panels, coming in an angle, can also be supported effectively. Below the stop surface 14, a panel-shaped shoulder 16 protrudes, the horizontal surface of which is referred to in the present contexts as anvil surface 18. When they strike the stop surface 14, the panels, which are not shown, run onto this anvil surface 18. The anvil surface drops off at an angle at the front edge, facing the viewer, so that the incoming panels run smoothly onto the anvil surface 18.

Adjoining the shoulder 16 or the anvil surface 18, the housing 12 is provided at both comers with vertical recesses 20, which are rectangular in cross section. According to FIG. 1, pivotably tracing fingers 22, 24 are located in these recesses and fastened on the two ends of a shaft 26 passing through the housing 12. As can be seen from FIG. 1, the tracing fingers, starting out from the boreholes, which have no reference number and accommodate the shaft 26, are each provided with a slot 28, through which a setscrew 30 passes. In this way, the two tracing fingers 22, 24 can be clamped to the shaft 26.

As can be seen in FIG. 1 because of the broken-open representation in the interior of the housing 12, a gearwheel 32 is mounted on the shaft 26 within the housing 12. This gearwheel 32 meshes with a toothed rack, which is circular in cross section and flattened on the underside and has toothed profiling at the flat underside. The toothed rack 34 is guided longitudinally displaceably in a sleeve 36 within the housing 12. A longitudinally displacement of the toothed rack 34 leads to a rotation of the gearwheel 32 and, with that, of the shaft 26 and accordingly, finally, to a swiveling of the tracing fingers 22, 24.

In the rear region of the toothed rack 34 of the representation of FIG. 1, there is a housing borehole 38, the diameter of which is larger than the diameter of the toothed rack and which is lined with a cylindrical sleeve 40. A longitudinally displaceable piston 42, which is fastened to the rear region of the toothed rack 34, is disposed in this sleeve 40. On its circumference, the piston has a seal, which is not labeled in detail. Between the piston 42 and an annular surface 44, which forms the boundary of the housing borehole 38 towards the viewer in FIG. 1, there is a helical compression spring 46, which puts the piston 42 and, with it, the toothed rack 34 under tension towards the rear in FIG. 1. In this retracted position, the two tracing fingers 22, 24 are lifted into the vertical readiness position, as can be seen in FIG. 1.

Figure 2:
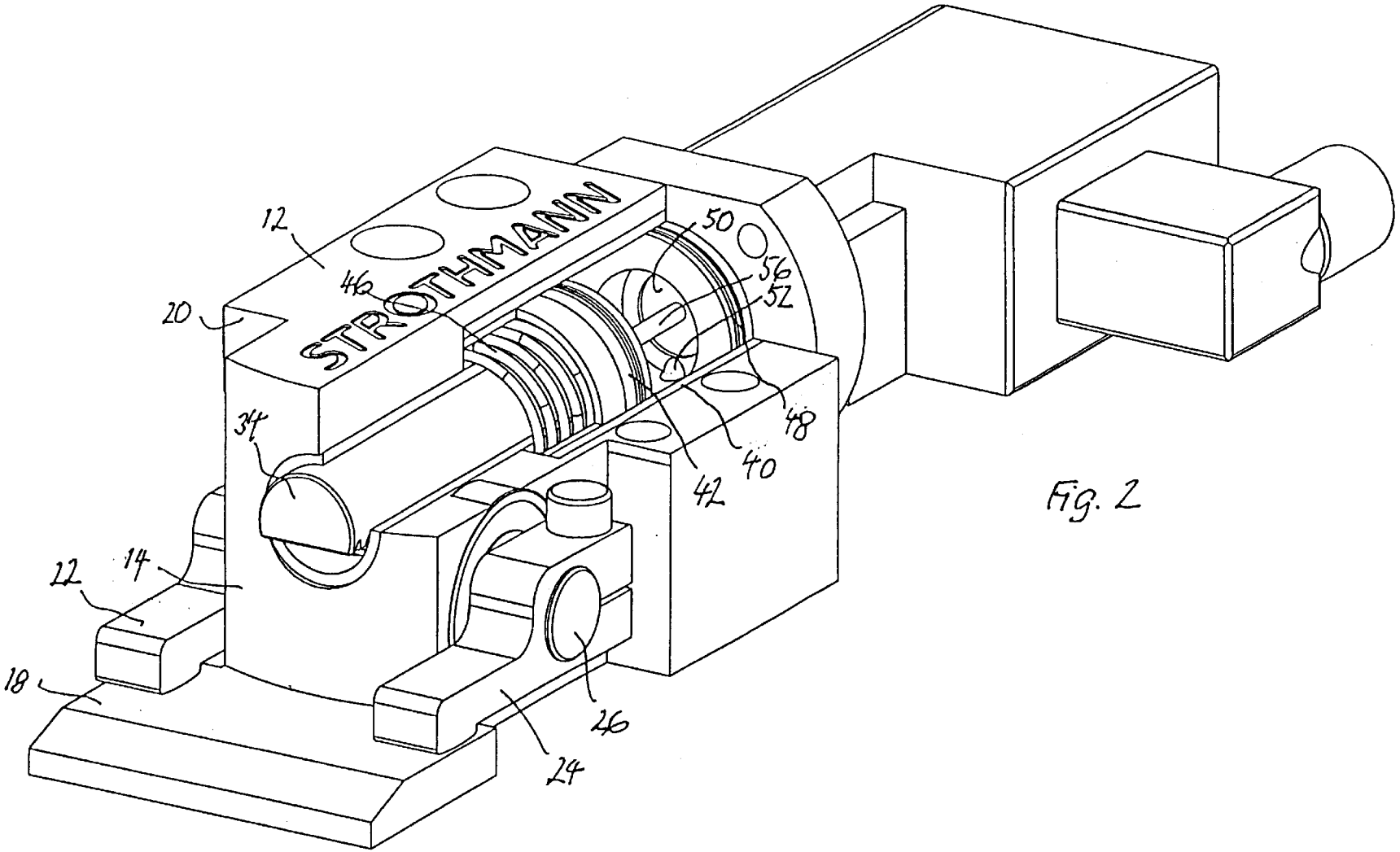

From this position, the tracing fingers 22, 24 can be swiveled until they come up against the horizontal anvil surface 18, as shown in FIG. 2. In this position, the piston 42 has been moved forward by the introduction of a pressure medium, especially of compressed air, whereas the helical compression spring 46 has been compressed. Due to the fact that the toothed rack 34 has engaged the gearwheel 32, the shaft 26 has been rotated through about 90 degrees. In FIG. 2, moreover, it can be seen that the sleeve 40 has been closed off airtight towards the right rear in FIG. 2 by a lid 48 and that a duct 52 for introducing compressed air is connected to a borehole 50 within the lid 48.

It can also be said that the tracing fingers 22, 24 can be moved back and forth between the readiness position shown in FIG. 1 and the measuring position shown in FIG. 2. If a panel has moved onto the anvil surface 18 in front of the stop surface 14, the tracing fingers 22, 24 of course lie against the surface of this panel and not against the surface of the anvil 18. The thickness of the panel can be measured in this way, in that a comparison is made between the position of the tracing fingers, when they lie on the anvil surface 18, and the position of the tracing fingers, when they lie on the panel. By introducing compressed air or a different pressure medium into the space between the lid 48 and the piston 42, a considerable force can be exerted on the tracing fingers 22, 24, so that measuring errors, which could arise, for example, from a curvature of the panel measured, can be excluded.

To determine the respective position of the tracing fingers 22, 24, a distance measuring device 54 is provided, which is shown in the drawing merely as a closed housing. The toothed rack 34 is connected coaxially with a rod 56, which enters the distance measuring device 54. This rod 56 is connected in the interior of the distance measuring device 54 with an iron core, which is not shown and can be shifted in the longitudinal direction in a coil arrangement of a so-called differential transformer. The coil arrangement usually has a primary coil and to oppositely connected secondary coils at the two longitudinal ends of the coil arrangement. Measuring equipment of this type is known and does not have to be explained in detail. It permits very accurate longitudinal measurements to be made, so that it is possible to determine the respective panel thickness accurately by a suitable conversion of the rotational movement of the shaft 26 and the longitudinal movement of the toothed rack 34. Of course, the measuring equipment used here, with a differential transformer, is to be regarded only as an example. In principle, any device for measuring length, which offers adequate accuracy, can be used.

What is claimed is:

1. A device for aligning and measuring the thickness of panels in a positioning conveyor which horizontally aligns panels and metal sheets, and has a conveying table, which is provided with a driving arrangement, said device comprising:

a stop adapted to be positioned at an edge of the conveying table, the stop including a housing, an anvil surface supporting the contacting panels at the stop, a thickness measuring device which is provided at the stop for measuring a panel thickness of contacting panels and metal sheets which contact the stop, said thickness measuring device including at least one tracing finger mounted in a position above the anvil surface at the stop and which can be swiveled to a lowered position, each tracing finger being fastened to a common shaft, passing through the housing of the stop, a toothed rack coupled with the thickness measuring device, a gear wheel fastened to the shaft, and which meshes with the toothed rack, and an arrangement for applying fluid pressure to longitudinally move the toothed rack.

2. The device of claim 1, further comprising a distance measuring device, and wherein the at least one tracing finger is connected with the distance measuring device.

3. The device of claim 2, wherein the distance measuring device is constructed to output a signal corresponding to the thickness of the panel when there is a difference between a measurement signal when the at least one tracing finger is lowered completely onto the anvil surface and when the at least one tracing finger is lowered onto the surface of a stop contacting panel.

4. The device of claim 3, wherein the at least one tracing finger includes two tracing fingers mounted transversely to a conveying direction of the panels and are offset at the stop.

5. The device of claim 3, wherein the distance measuring device comprises a differential transformer.

6. The device of claim 2, wherein the distance measuring device comprises a differential transformer.

7. The device of claim 2, wherein the at least one tracing finger includes two tracing fingers mounted transversely to a conveying direction of the panels and are offset at the stop.

8. The device of claim 1, wherein the at east one tracing finger includes an axle connected with an angle-measuring device.

9. The device of claim 1, wherein the at least one tracing finger includes two tracing fingers mounted transversely to a conveying direction of the panels and which are offset at the stop.

* * * * *